United States Patent [19]

Renfro

[11] Patent Number: 5,025,962

[45] Date of Patent: Jun. 25, 1991

[54] AUTOMATIC TIMED RELEASE SPRAY DISPENSER

[75] Inventor: Wesley E. Renfro, Baton Rouge, La.

[73] Assignee: Robert J. LeBlanc, Baton Rouge, La.

[21] Appl. No.: 464,533

[22] Filed: Jan. 12, 1990

[51] Int. Cl.[5] ..... B65D 83/26

[52] U.S. Cl. ..... 222/649; 222/61; 222/645; 137/624.14

[58] Field of Search ..... 222/645, 649, 402.14, 222/61; 137/624.14, 624.18

[56] References Cited

U.S. PATENT DOCUMENTS

| | | | |
|---|---|---|---|
| 3,477,613 | 11/1969 | Mangel | 222/70 |
| 3,497,108 | 2/1970 | Mason | 222/61 |
| 3,589,562 | 2/1969 | Buck | 222/70 |
| 3,667,502 | 6/1972 | Otto | 137/624.14 |
| 3,722,749 | 3/1973 | Ishida | 222/61 |
| 3,756,465 | 9/1973 | Meshberg | 222/61 |
| 3,794,216 | 2/1974 | Buck | 222/70 |
| 3,968,905 | 7/1976 | Pelton | 222/70 |
| 4,469,255 | 9/1984 | Will et al. | 222/649 |
| 4,501,409 | 2/1985 | Will et al. | 251/354 |
| 4,544,066 | 10/1985 | Hill et al. | 222/649 |

*Primary Examiner*—Andres Kashnikow
*Assistant Examiner*—Karen B. Merritt
*Attorney, Agent, or Firm*—David L. Ray

[57] ABSTRACT

A valve assembly for attachment to a pressurized aerosol can which automatically releases a measured amount of spray at preset time intervals utilizing the pressure of the contents of the aerosol as the sole energy source to drive the valve assembly of the invention.

20 Claims, 5 Drawing Sheets

AUTOMATIC TIMED RELEASE SPRAY DISPENSER

BACKGROUND OF THE INVENTION

1. Field of the Invention

The invention relates to automatic, pressure activated timer devices for attachment to an aerosol can and more particular to a pressure powered timed release valve for a spray can.

2. Description of the Prior Art

Adjustable valving mechanisms are known in the art. Such valving mechanisms periodically release qualities of an aerosol spray. Exemplary of such prior art are the following U.S. Patents:

U.S. Pat. No. 4,544,086 discloses a ornament including an automatic and adjustable valving mechanism in which a spray of pressurized fluid from an aerosol can is released in intermittent sprays occurring in cycles of adjustable length. The valving mechanism consists of a body having an actuating bar mounted on drive rods which can be latched in an elevated position by a latch plate. Contact between the actuating bar and the nozzle of a pressure source, such as an aerosol can, releases pressurized fluid from the aerosol can into a first internal chamber of the valving mechanism. The pressurized fluid acts upon a diaphragm to force hydraulic fluid from the first chamber into a second chamber, which raises a piston which, in turn, raises the rods supporting the actuating bar, to terminate the discharge of the pressurized fluid from the aerosol can. The raising of the drive rods supporting the actuating bar permits a latch plate to lock the drive rods in an elevated position while a sufficient transfer of hydraulic fluid from the first chamber to the second open a discharge conduit for the valving mechanism. A release of the pressurized fluid from the valving mechanism permits the piston rod to drop and disengage the latch plate from the drive rods so that the actuating bar can again contact the aerosol can nozzle for initiating bar can again contact the aerosol can nozzle for initiating a further cycle. In one embodiment, the aerosol can contains a pine tree scent and the valving mechanism, as well as the aerosol can are mounted within a lighted ornament which may be attached to an artificial Christmas tree.

U.S. Pat. No. 4,501,409 discloses a tilt valve for an aerosol can constructed so that it can be actuated only by transverse tilting forces. An output valve stem assembly is sealed to a valve housing whose inlet communicates with the interior of the aerosol can. A tilt element is biased against the bottom of the output valve assembly so as to seal the interior of the valve housing. A barrel-shaped spring is used to bias the tilt element so that the resistance of the output stem to tilting, and the stroke required for actuation, are reduced. The input stem and the bottom of the tilt element provide a secondary valve which is closed upon the output stem being subject to downward axial forces. Therefore, only transverse forces provided by an automatic actuating device can be used to actuate the tilt valve assembly.

U.S. Pat. No. 4,469,255 discloses an automatic and adjustable valving mechanism in which a spray of pressurized fluid from a pressurized source having a pressure release gate, such as an aerosol can, is released in intermittent sprays occurring in cycles of adjustable length. The valving mechanism consists of a body having an actuating bar mounted on drive rods which can be latched in an elevated position by a latch plate. Contact between the actuating bar and the nozzle of a pressure source, such as an aerosol can, releases pressurized fluid acts upon a diaphragm to force hydraulic fluid from a first chamber into a second chamber, which has the effect of raising a piston which, in turn, raises the rods supporting the actuating bar, so that the discharge of the pressurize fluid from the nozzle of the aerosol can is terminated. The raising of the drive rods supporting the actuating bar permits a latch plate to lock the drive rods in an elevated position while a sufficient transfer of hydraulic fluid from the first chamber to the second opens a discharge conduit for the valving mechanism. A release of the pressurized fluid from the valving mechanism permits the piston rod to drop and discharge the latch plate from the drive rods so that the actuating bar can again contact the aerosol can nozzle for initiating a further cycle.

U.S. Pat. No. 3,968,905 discloses a time release aerosol dispenser for timed release of measured quantities of an aerosol spray by attachment of an improved dispenser to a conventional aerosol container. The contents of the container are controllably passed through a porous entered plug and a flow restricting orifice into a measuring chamber in the body of the dispenser. The exit passage of this chamber is sealed by a spring disk which is concave upward with its periphery seated against a shoulder encircling the exit orifice. As the container contents enter the chamber, the pressure therein rises until it is sufficient to overcome the spring resistance of the disk. When this occurs, the disk snaps into its stressed condition, assuming a concave downward shape. It is then supported on projections formed on the exit orifice shoulder. These projections retain the stressed disk in spaced relation to the exit orifice and allow a quantity of the chamber contents a pass around the disk and escape through a nozzle mounted on the exit orifice. As the chamber contents escape, the pressure within the chamber diminishes until the disk snaps back to its original shape. The cycle is then repeated.

U.S. Pat. No. 3,794,216 discloses a pressure powered aerosol timer for aerosol spray cans which operate automatically to periodically spray the contents of the can at desired, predetermined intervals, the pressure within the can being utilized to actuate the timer.

U.S. Pat. No. 3,722,749 discloses a aerosol spray container having a spray valve constructed which will intermittently spray measured amounts of the container contents in an automatic sequence, but which also be operated manually, when it is desired to override the automatic operation.

U.S. Pat. No. 3,589,562 discloses a pressure operated variable timer for aerosol spray cans for automatically operating the can to periodically spray the contents at desired predetermined intervals, the pressure within the can being utilized to actuate the timer.

U.S. Pat. No. 3,477,613 discloses an aerosol dispenser actuated by propellant pressure. A flow-control valve allows pressurized liquid to leak slowly from an aerosol container into a chamber having a valve-actuating, snap-action diaphragm on one side thereof. The diaphragm is spherically crowned toward a first, valve-closed position, and any pressure applied against the concave side creates internal stresses within the diaphragm, causing it to resist deflection under load. As pressure builds up in the chamber, it pushes the diaphragm past a certain point, causing it to snap over to a second, valve-open position. As pressure is released through the open valve, the diaphragm snaps back to its original valve-closed position.

SUMMARY OF THE INVENTION

In accordance with the present invention, there is provided a valve assembly for attachment to a pressurized aerosol can which automatically releases a measured amount of spray at preset time intervals utilizing the pressure of the contents of the aerosol as the sole energy source to drive the valve assembly of the invention.

BRIEF DESCRIPTION OF THE DRAWINGS

The invention will be more clearly understood by reference to the drawings, in which.

DESCRIPTION OF THE PREFERRED EMBODIMENTS

Figure 1:
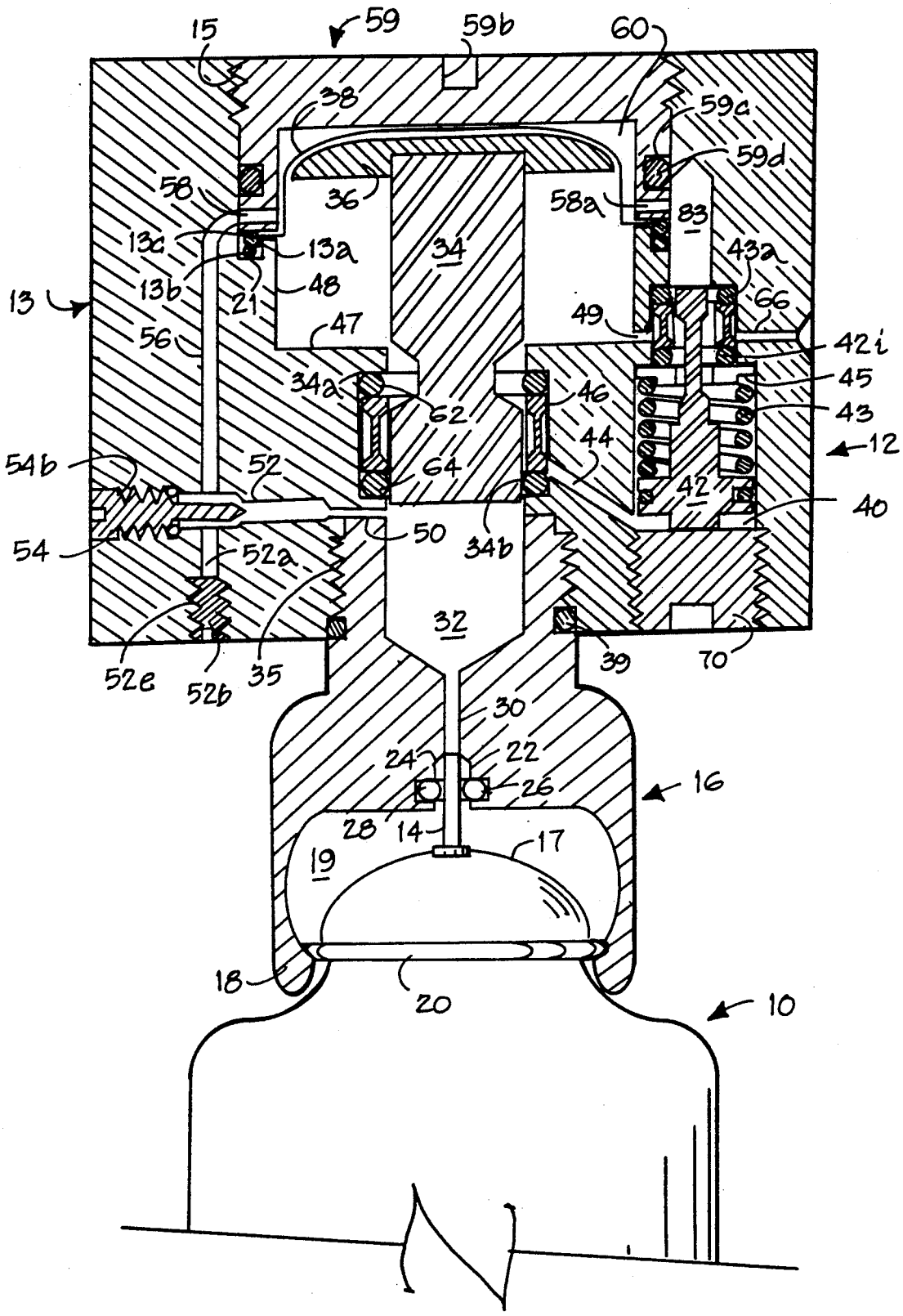
FIG. 1 is a cross-sectional, elevational view of the automatic spray dispenser of the invention.
Figure 2:
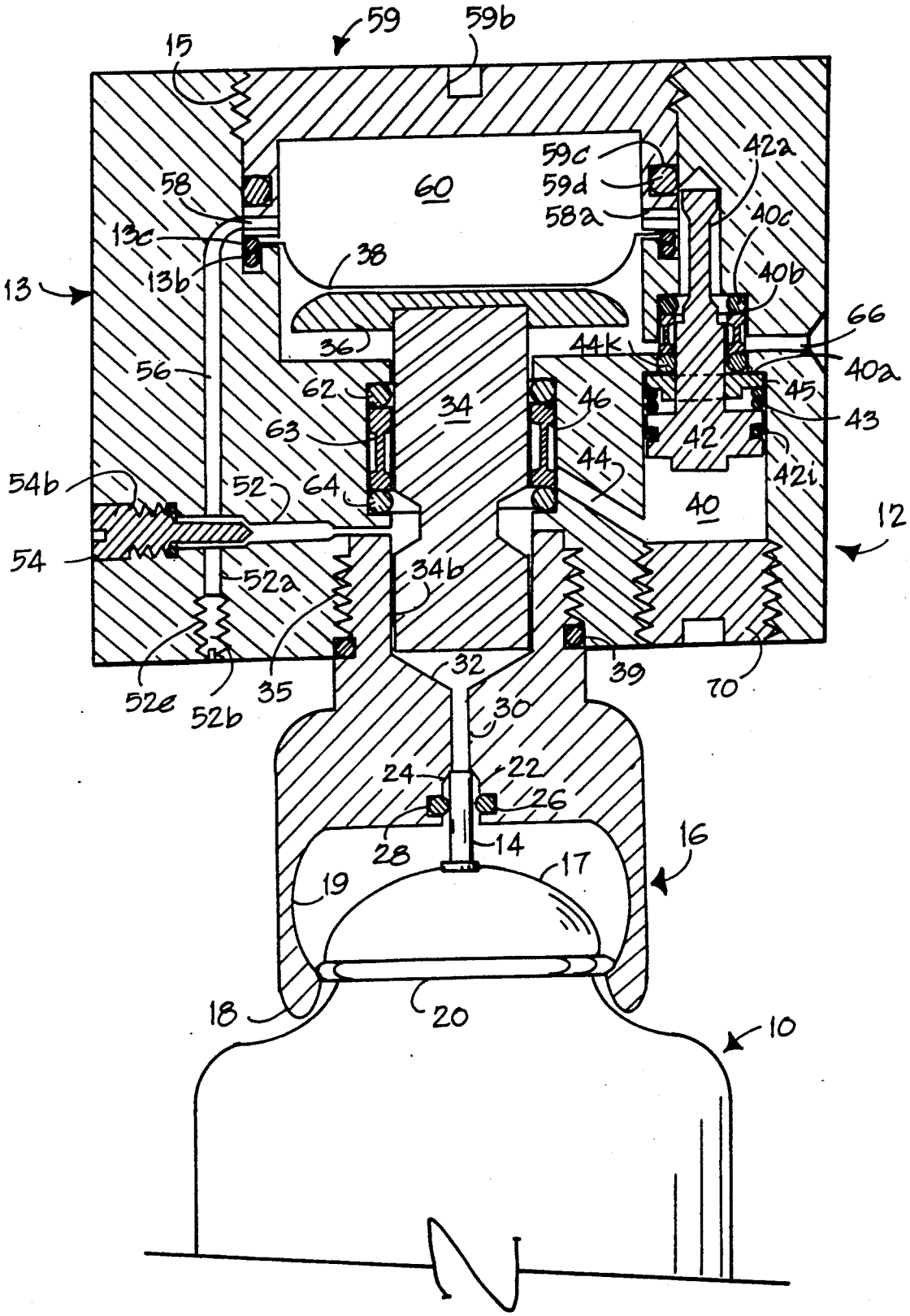
FIG. 2 is a cross-sectional, elevational view of the automatic spray dispenser of the invention.

Referring now to the drawings, in FIGS. 1 and 2 is shown an aerosol can generally indicated by the numeral 10 to which is attached the valve assembly of the invention generally indicated by the numeral 12. The aerosol can 10 is a conventional aerosol can well known in the art which contains a product to be dispensed and a propellant for dispensing the product. The aerosol can 10 has a conventional valve stem 14 extending upwardly therefrom which releases fluids under pressure when depressed. In addition to aerosol, the valve assembly of the present invention may be utilized with any pressurized reservoir from which it is desired to dispense the contents automatically and periodically.

Figure 9:
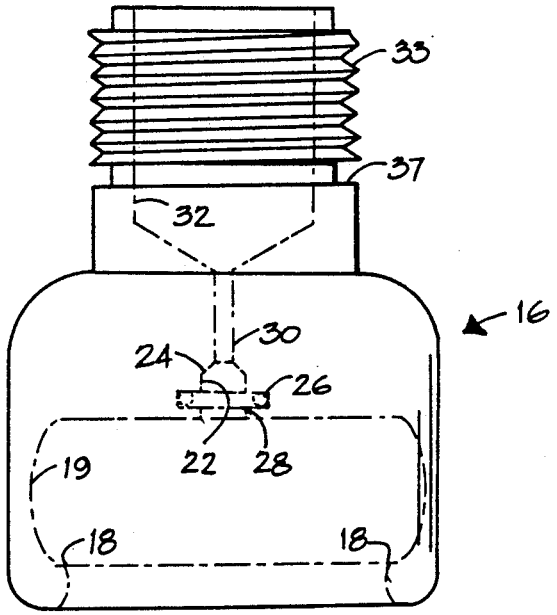
FIG. 9 is an elevational, plan view of the aerosol can adapter of the automatic spray dispenser of the invention.

Valve assembly 12 includes the valve body generally indicated by the numeral 13 which is connected to aerosol can 10 by the aerosol can adapter generally indicated by the numeral 16 which is shown in FIG. 1 and FIG. 2, and in greater detail in FIG. 9. Aerosol can adapter 16 has a annular lip 18 which protrudes inwardly from cavity 19 and fastens around the rim 20 of aerosol can 10, thus holding aerosol can adapter 16 securely to aerosol can 10. Cavity 19 receives the top 17 of aerosol can 10.

Aerosol can adapter 16 has a cylindrical cavity 22 therein which receives the end of valve stem 14. The upper portion or ceiling 24 of cavity 22 strikes the top of valve stem 14 and depresses the valve stem as aerosol can adapter 16 is snapped upon the top of aerosol can 10. An "O" ring 26 contained in annular recess 28 in aerosol can adapter 16 forms a seal with valve stem 14 to prevent pressurized fluids being released from valve stem 14 from flowing downwardly.

Connected to the upper end of cylindrical cavity 22 is cylindrical channel 30 which conveys fluids from cavity 22 to the upper cavity 32 of aerosol can adapter 16. On the exterior of aerosol can adapter 16 surrounding cavity are external threads 33. Threads 33 are received in internal threads 35 of valve body 13. Preferably, an annular slot 37 shown in FIG. 9 is formed in aerosol can adapter 16 for receipt of "O" ring 39 which forms a pressure tight seal between aerosol can adapter 16 and valve body 13 as shown in FIGS. 1 and 2.

Immediately after aerosol can adapter 16 is snapped onto rim 20 of aerosol can 10, cylindrical channel 30 conveys fluids under pressure to cylindrical cavity 32 in aerosol can adapter 16. As pressure increases in cavity 32, pressure is applied to metering rod 34 forcing metering rod 34, metering rod cap 36, and diaphragm 38 upwardly to the position shown in FIG. 1.

Figure 11:
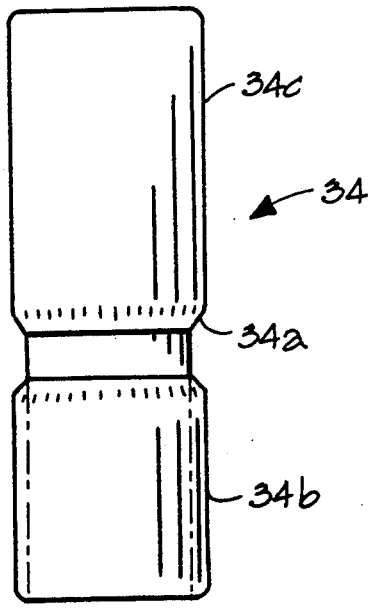
FIG. 11 is an elevational, plan view of the metering rod of the automatic spray dispenser of the invention.

Metering rod 34 is shown in greater detail in FIG. 11. Metering rod 34 is generally cylindrical in shape and has a groove or recess **34*a*** slightly beneath the center thereof.

Figure 10:
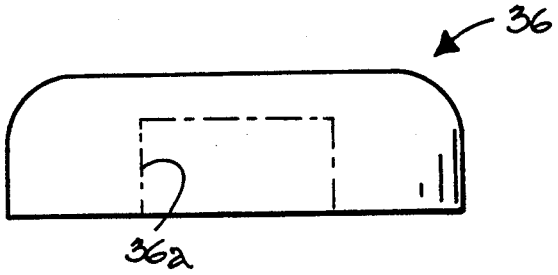
FIG. 10 is an elevational, plan view of the rod cap of the automatic spray dispenser of the invention.

Connected to the top of the upper end **34*c* of metering rod 34 is metering rod cap 36 which also moves upwardly with metering rod 34. Metering rod cap 36 is shown in greater detail in FIG. 10. Metering rod cap 36 is generally cylindrical is shape and has a cylindrical cavity 36*a* therein for the receipt of the upper end 34*c* of metering rod 34. Preferably the upper end 34*c* of metering rod 34 is force fitted into cavity 36*a* of rod cap 36, although, if desired, the upper end 34*c* of metering rod 34 could be glued to cavity 36*a*** if desired.

Figure 7:
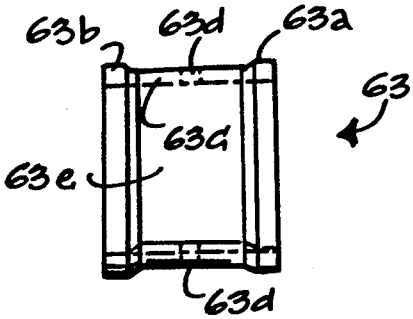
FIG. 7 is a plan view of another of the spacer bushings of the spray dispenser of the invention.

An "O" ring 64 contained in cavity 46 of valve assembly body 13 maintains a sliding, pressure tight seal with the lower portion **34*b* of metering rod 34, and an "O" ring 62 contained in cavity 46 above "O" ring 64 maintains a sliding, pressure tight seal with the upper portion 34*c* of metering rod 34. Both of the "O" rings 62 and 64 are held apart by spacer bushing 63 which is shown in FIGS. 1, 2, and 7. As shown in detail in FIG. 7, spacer bushing 63 has two enlarged rings 63*a* and 63*b* at each end thereof, a cylindrical cavity 63*c* inside for receipt of metering rod 34, and two cylindrical holes 63*d*—63*d* in cylindrical wall 63*e* of spacer bushing 63** for passage of fluids therethrough.

Located above rod cap 36 is elastic diaphragm 38 which is forced upwardly by rod cap 36. Diaphragm 38 is held in place by the body cap generally indicated by the numeral 59 in FIGS. 1 and 2, and in detail in FIG. 8. Body cap 59 is generally cylindrical and has a cylindrical cavity 60 therein for receipt of diaphragm 38, rod cap 36, and metering rod 34. Body cap 59 has entrance channel 58 therein through which fluids under pressure enter cavity 60, and an exit channel **58*a* through which fluids under pressure exit from cavity 60. External threads 59*a* are located on the upper end of the exterior of body cap 59 for receipt in valve body threads 15 located on the top of valve assembly body 13. Located in the top of body cap 59 is longitudinal slot 59*b* for receipt of a screwdriver or other tool for fastening or removing body cap 59**.

Figure 8:
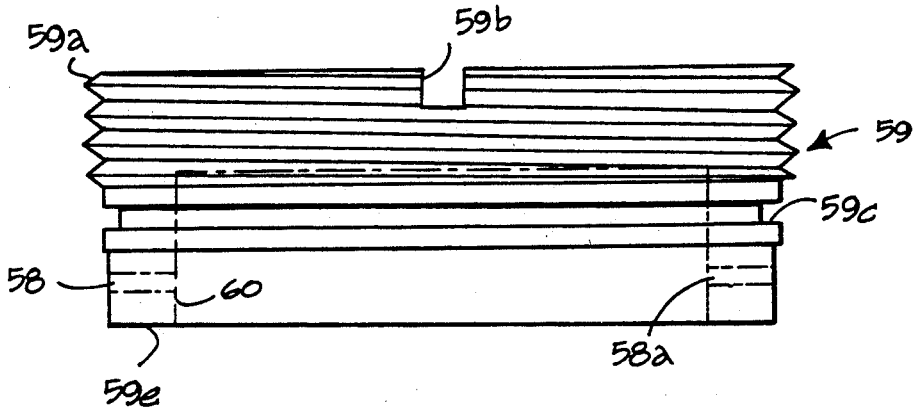
FIG. 8 is an elevational, plan view of the rod cap of the automatic spray dispenser of the invention.

Body cap 59 has an annular groove or slot 59c therein for receipt of "O" ring 59d as shown in FIGS. 1, 2, and 8. As body cap 59 is screwed downwardly, the bottom edge 59e of body cap 59 forces diaphragm 38 against annular ridge 13a of valve assembly body 13 to form a pressure tight seal. If desired, one or two "O" rings 13b and 13c may be inserted in annular slot 21 in valve assembly body 13 to form an additional seal with diaphragm 38 as body cap 59 is screwed downwardly. Diaphragm 38 extends horizontally in cavity 48 when valve assembly 12 is not connected to aerosol can 10.

As metering rod 34 moves upwardly, metering rod groove 34a exhausts gas from cavity 46 into cavity 48. Gas in cavity 46 was placed under pressure by exhaust valve 42 being forced downwardly by coil spring 43 in lower exhaust valve cavity 40 and traveling to metering rod cavity 46 through channel 44.

Figure 12:
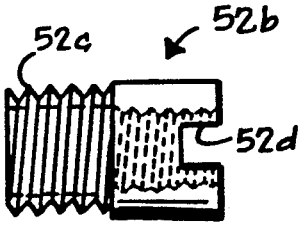
FIG. 12 is a plan view of a plug of the automatic spray dispenser of the invention.
Figure 4:
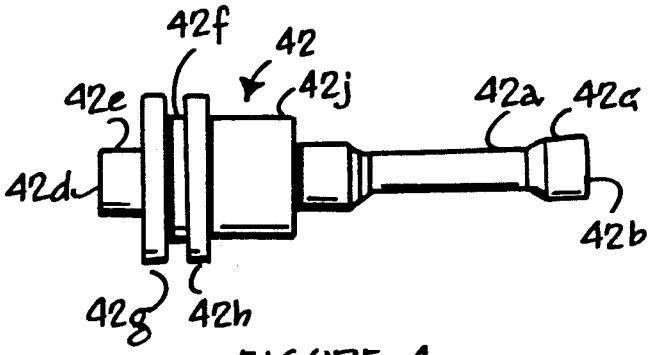
FIG. 4 is a plan view of the exhaust valve of the automatic spray dispenser of the invention.
Figure 5:
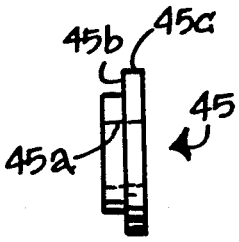
FIG. 5 is a plan view of the seal retainer of the automatic spray dispenser of the invention.

Exhaust valve 42 is shown in detail in FIG. 4. Exhaust valve 42 is generally cylindrical in shape and has an annular tapered groove or recess 42a near the top end 42b thereof. Adjacent to top end 42b is upper cylinder 42c which travels upwardly and downwardly in upper exhaust valve cavity 83. A pressure tight, sliding seal is maintained between upper cylinder 42c of exhaust valve 42 and upper exhaust valve cavity 83 by "O" ring 43a. At the lower end of exhaust valve 42 is cylindrical post 42e which is received in cylindrical cavity 45a of the cylindrical seal generally indicated by the numeral 45 in FIG. 5 which aids in maintaining a sliding seal between the bottom of exhaust valve 42 and the side walls of lower exhaust valve cavity 40. Exhaust valve 42 is contained in valve body 13 by externally threaded plug 70 shown in FIGS. 1 and 2 which is similar to the plug 52b shown in FIG. 12 in detail. An annular slot is formed between two friction rings 42g and 42h formed on exhaust valve 42 for receipt of "O" ring 42i.

Figure 6:
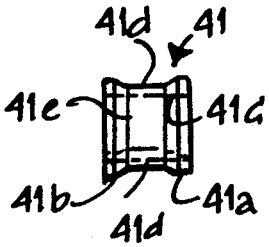
FIG. 6 is a plan view of one of the spacer bushings of the automatic spray of the invention.

Coil spring 43 located in lower exhaust valve cavity 40 presses downwardly against friction ring 42h and upwardly against the underside 45b of retainer lip 45c of seal retainer 45. Seal retainer 45 fits against top 40a of lower exhaust valve cavity 40. Top 40a has a cylindrical cavity 40b therein into which the center portion 42j and "O" ring 44k is received. Holding "O" ring downwardly is the generally cylindrical spacer bushing generally indicated by the numeral 41 in FIGS. 1 and 6. As can be seen in detail in FIG. 6, spacer bushing 41 has two enlarged rings 41a and 41b at each end thereof, a cavity 41c inside for receipt of exhaust valve 42, and two cylindrical holes 41d—41d in cylindrical wall 41e for passage of fluids therethrough. At the upper end of cavity 40b is "O" ring 40c which is held upwardly by spacer bushing 41.

As metering rod 34 moves above channel 50, channel 50 is open to fluids under pressure in cavity 32 and fluids under pressure enter metering valve channel 52. Fluids under pressure from metering valve channel 52 are metered by metering valve 54 which may be adjusted to vary the timing sequence of the automatic spray release. The channel 52a beneath metering valve 54 is plugged by plug 52b shown in FIGS. 1, 2, and 12. As shown in detail in FIG. 12, plug 52b has external threads 52c thereon which engage internal threads 52e in valve body 13, and plug 52b has a slot 52d for receipt of a screwdriver or other tool for turning plug 52b.

Figure 3:
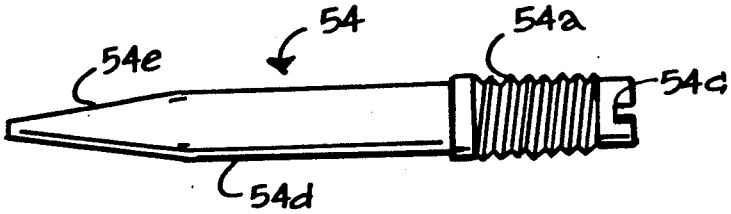
FIG. 3 is a plan view of the metering valve of the automatic spray dispenser of the invention.

Metering valve 54 is shown in greater detail in FIG. 3. Metering valve 54 is generally cylindrical in shape, and has external threads 54a thereon which engage internal threads 54b formed in valve assembly body 13. A slot 54c is formed in the outside end of metering valve 54. On the inside end of metering valve 54 is cylindrical needle valve 54d having tapered portion 54e which is inserted into channel 52 to meter the flow of fluids under pressure through channel 52. Gases under pressure pass by metering valve 54 and into channel 56 and travel through channel 58 to the cavity 60 above diaphragm 38.

As pressure rises in cavity 60, diaphragm 38 pushes down against rod cap 36 which in turn pushes metering rod 34 down past "O" rings 62 and 64 as shown in FIG. 2. As metering rod groove 34a reaches "O" ring 64, pressurized fluids are released into cavity 46 and into channel 44 to force exhaust valve 42 upwardly to the position shown in FIGS. 2 which permits gas in cavity 60 above diaphragm 38 to exhaust through port 58a around the groove 42a in exhaust valve 42 and outwardly through port 66 to the atmosphere.

As fluids under pressure are exhausted to the atmosphere from cavity 60, the pressure drops in cavity 60, and fluids under pressure in cavity 32 force metering rod 34, rod cap 36, and diaphragm 38 upwardly. When metering rod 34 reaches the position shown in FIG. 1, the upper edge of groove 34a has risen above the bottom 47 of cavity 48, thereby releasing fluids under pressure in lower exhaust valve cavity 40 through channel 44, through cavity 46, around "O" ring 62, and through groove 34a into cavity 48. From cavity 48 the small amount of fluids under pressure released from lower exhaust valve cavity 40 travel through channel 49, around the groove 42a of exhaust valve 42, and outwardly through port 66 to the atmosphere. The sequence then repeats until all pressure is depleted in the aerosol can.

Although the preferred embodiments of the present invention have been disclosed and described in detail above, it should be understood that the invention is in no sense limited thereby, and its scope is to be determined by that of the following claims:

What is claimed is:

1. An automatic and adjustable valve assembly for the timed release of pressurized fluid from an output valve means of a pressurized fluid reservoir, said valve assembly comprising:

a. first cavity means for receiving the pressurized contents of said pressurized fluid reservoir and for receiving metering rod means for metering the amount of said pressurized contents released from said valve assembly, said metering rod means having a lower end and an upper end, said lower end of said metering rod means being movable upwardly and downwardly in said first cavity means, b. second cavity means for receiving the pressurized contents of said pressurized fluid reservoir and said upper end of said metering rod means, said second cavity means being cylindrical in shape and having generally cylindrical side walls, said metering rod means being movable upwardly and downwardly in said second cavity means, c. diaphragm means connected to said sidewalls of said second cavity means for dividing said second cavity means into upper cavity means for receiving a first portion of said pressurized contents of said pressurized fluid reservoir and lower cavity means for receiving a second portion of said pressurized contents of said pressurized fluid reservoir, d. first channel means for conveying said pressurized contents of said pressurized fluid reservoir from said first cavity means to said upper cavity means in said second cavity means, e. metering valve means connected to said first channel means for varying the flow of said pressurized contents of said pressurized fluid reservoir delivered to said upper cavity means in said second cavity means, f. exhaust valve means for periodically releasing said pressurized contents of said pressurized fluid reservoir to the atmosphere, said exhaust valve means having an upper end and a lower end, g. biasing means for biasing said exhaust valve means in one direction, h. upper exhaust valve cavity means for slidably receiving said upper end of said exhaust valve means and for receiving the pressurized contents of said pressurized fluid reservoir contained in said upper cavity means of said second cavity means, i. lower exhaust valve cavity means for slidably receiving the lower end of said exhaust valve means and said biasing means, j. second channel means for conveying said pressurized contents of said pressurized fluid reservoir from said first cavity means to said lower exhaust valve cavity means and for conveying said pressurized contents of said pressurized fluid reservoir contained in said lower exhaust valve cavity means to said lower cavity means of said second cavity means, k. third channel means for conveying said pressurized contents of said pressurized fluid reservoir to the atmosphere, l. fourth channel means for conveying said pressurized contents of said pressurized fluid reservoir to said upper exhaust valve cavity means, and m. fluid reservoir adapter means for connecting said valve assembly to said pressurized fluid reservoir.

2. The automatic and adjustable valve assembly of claim 1 wherein said first cavity means is partially located in said fluid reservoir adapter means.

3. The automatic and adjustable valve assembly of claim 2 wherein said output valve means is a depressible valve stem connected to said pressurized fluid reservoir.

4. The automatic and adjustable valve assembly of claim 3 wherein said fluid reservoir adaptor means has valve stem cavity means therein for receiving and depressing said valve stem connected to said pressurized fluid reservoir.

5. The automatic and adjustable valve assembly of claim 4 wherein said fluid reservoir adapter means has channel means for connecting said valve stem cavity means to said first cavity means.

6. The automatic and adjustable valve assembly of claim 5 wherein said valve stem cavity means has seal means therein to prevent said pressurized fluids from leaking from said valve stem.

7. The automatic and adjustable valve assembly of claim 1 wherein said biasing means is a coil spring.

8. The automatic and adjustable valve assembly of claim 1 wherein said metering rod means comprises a generally cylindrical shaped rod.

9. The automatic and adjustable valve assembly of claim 8 wherein said rod has a groove means therein for admitting the contents of said pressurized fluid reservoir to and from said lower exhaust valve cavity means.

10. The automatic and adjustable valve assembly of claim 9 wherein seal means contacts said rod means and maintains a sliding seal therewith between said first cavity means and said rod means and said lower cavity means in said second cavity means.

11. The automatic and adjustable valve assembly of claim 1 wherein said metering valve means comprises a threaded cylinder threaded into said valve assembly having a needle valve means connected thereto.

12. The automatic and adjustable valve assembly of claim 1 wherein said exhaust valve means is generally cylindrical in shape.

13. The automatic and adjustable valve assembly of claim 12 wherein seal means contacts said exhaust valve means and maintains a sliding seal therewith between said upper exhaust valve cavity means and said lower exhaust valve cavity means.

14. The automatic and adjustable valve assembly of claim 1 wherein said diaphragm is elastic.

15. The automatic and adjustable valve assembly of claim 14 wherein said biasing means is a coil spring.

16. The automatic and adjustable valve assembly of claim 15 wherein said pressurized fluid reservoir is an aerosol can.

17. The automatic and adjustable valve assembly of claim 16 wherein said output valve of said aerosol can is a depressible valve stem.

18. The automatic and adjustable valve assembly of claim 17 wherein said metering rod means comprises a generally cylindrical shaped rod.

19. The automatic and adjustable valve assembly of claim 18 wherein said exhaust valve means is generally cylindrical in shape.

20. The automatic and adjustable valve assembly of claim 19 wherein said metering valve means comprises a threaded cylinder threaded into said valve assembly having a needle valve means connected thereto.

* * * * *